US005849169A

United States Patent [19]

Aikawa et al.

[11] Patent Number: 5,849,169

[45] Date of Patent: Dec. 15, 1998

[54] METHOD FOR ELECTRICALLY COLORING ALUMINUM MATERIAL AND GRAY-COLORED ALUMINUM MATERIAL OBTAINED THEREBY

[75] Inventors: Kazuo Aikawa, Namerikawa; Satoshi Ishikura; Makoto Kato, both of Kurobe, all of Japan

[73] Assignee: YKK Corporation, Tokyo, Japan

[21] Appl. No.: 972,506

[22] Filed: Nov. 18, 1997

[30] Foreign Application Priority Data

Nov. 18, 1996 [JP] Japan ..... 8-321156

[51] Int. Cl.[6] ..... C25D 11/22

[52] U.S. Cl. ..... 205/50; 205/173; 428/472.2

[58] Field of Search ..... 205/173, 105, 205/202, 50; 428/472.2; C25D 11/22

[56] References Cited

U.S. PATENT DOCUMENTS

| | | | |
|---|---|---|---|
| 3,773,631 | 11/1973 | Immel et al. | 205/173 |
| 3,962,049 | 6/1976 | Ueki | 205/106 |
| 3,977,948 | 8/1976 | Martinez | 205/105 |
| 3,989,605 | 11/1976 | Yanagida | 205/139 |
| 4,014,758 | 3/1977 | Kawai et al. | 205/105 |
| 4,066,816 | 1/1978 | Sheasby | 428/336 |

FOREIGN PATENT DOCUMENTS

| | | |
|---|---|---|
| 61-204395 | 9/1986 | Japan . |
| 63-223199 | 9/1988 | Japan . |

OTHER PUBLICATIONS

Database WPI, Section CH, Week 9519, No date available Derwent Publications Ltd., London, GB; Class M11, AN 95–145297. XP–002058461 & JP 07 070 791 A (Metarex KK).

Database WPI, Section Ch, Week 8843, No date available Derwent Publications Ltd., London, GB; Class M11, AN 88–303843, XP–002058462 & JP 63 223 199 A (Korona Kogyo KK).

Patent Abstracts of Japan, vol. 007, No. 056 (C–155), 8 Mar. 1983 & JP 57 207197 A (Nippon Kentetsu KK), 18 Dec. 1982.

Chemical Abstracts, vol. 86, No. 18, 2 May 1977, Columbus, Ohio, US; Abstract No. 129964, Suzuki, Ryoji: "Rapid coloring of anodized aluminum", XP–002058460 & JP 51 122 637 A (Japan).

*Primary Examiner*—Kathryn L. Gorgos
*Assistant Examiner*—William T. Leader
*Attorney, Agent, or Firm*—Hill & Simpson

[57] ABSTRACT

Disclosed are a method for electrolytically coloring an aluminum material which is capable of coloring an anodic oxide film in a gray color and a gray-colored aluminum material obtained thereby. In a method for electrolytically coloring an aluminum material having the anodic oxide film formed on the surface thereof in an electrolytic coloring solution containing an inorganic metal salt, a strongly acidic electrolytic coloring solution containing sulfuric acid, stannous sulfate, nickel sulfate, and ammonium sulfate and having a pH of not more than 2.5 is used as the electrolytic coloring solution. Preferably the electrolytic coloring solution contains sulfuric acid at a concentration in the range of 3 to 30 g/liter, stannous sulfate at a concentration in the range of 0.1 to 3.0 g/liter, nickel sulfate at a concentration in the range of 10 to 100 g/liter, and ammonium sulfate at a concentration in the range of 20 to 100 g/liter. By this method, a gray-colored aluminum material possessed of an anodic oxide film colored in an achromatic or substantially achromatic gray color is obtained.

5 Claims, No Drawings

METHOD FOR ELECTRICALLY COLORING ALUMINUM MATERIAL AND GRAY-COLORED ALUMINUM MATERIAL OBTAINED THEREBY

BACKGROUND OF THE INVENTION

1. Field of the Invention

This invention relates to a method for electrolytically coloring an aluminum material in a gray color and a gray-colored aluminum material obtained thereby. The term "aluminum material" as used in the present specification refers to a material formed of aluminum or an aluminum alloy.

2. Description of the Prior Art

The aluminum material having an anodic oxide film formed thereon excels in weatherability, resistance to corrosion, and durability and has been finding utility in a wide range of applications including building materials such as sashes, panels, horizontally sliding doors, and entrance doors, parts for vehicles and ships, and articles for daily use such as portable stepladders and stationary ladders.

The color tones of the heretofore produced anodic oxide films, however, have been predominantly bronze to black. In recent years, the diversification of users' needs has come to urge the production of anodic oxide films of the color tone of gray.

As a means to form a gray-colored oxide film on the aluminum materials, the so-called integral color anodizing process which effects the formation of a gray-colored anodic oxide film by incorporating Si, Mn, etc. in an aluminum alloy and subjecting the resultant alloy to the treatment of anodic oxidation has led other methods.

Since this method involves manufacture of an aluminum alloy having additive elements specially blended therein, however, it necessitates control of the texture of the alloy and suffers an addition to cost. It has been also known to incur difficulty in obtaining an anodic oxide film of a uniform color tone, depending on the conditions used for the formation of the anodic oxide film.

Meanwhile, the so-called electrolytic coloring process is widely known which attains the coloration by subjecting an anodized aluminum material to electrolytic treatment under alternating current conditions in an electrolytic coloring solution containing a metal salt thereby inducing deposition of a metal colloid or metal salt in the micropores of the anodic oxide film and consequent coloration of the anodic oxide film.

Several cases of coloring an anodic oxide film in a gray color by this electrolytic coloring process have been reported (Japanese Patent Application, KOKAI (Early Publication) No. 61-204,395 and Japanese Patent Publication No. 62-33,318, for example). Virtually none of them, however, has been reduced to practice. This unfortunate development may be logically explained by supposing that these colored anodic oxide films barely look grayish when they have very light colors and consequently the relevant methods are unfit for the purpose of production on a commercial scale.

Further, such methods as obtain gray-colored aluminum materials by using an electrolytic treatment in addition to the series of treatments of anodic oxidation and electrolytic coloring have been reported. Japanese Patent Application, KOKAI No. 63-223,199, for example, discloses a method which comprises subjecting an aluminum material having an anodic oxide film formed in advance thereon in a sulfuric acid bath to electrolytic coloring in an electrolytic coloring bath having a pH of not less than 4.5 and containing a mixture of a nickel salt and a zinc salt or a mixture of a nickel salt, a zinc salt, and a molybdenum salt as coloring components, nickel ions as a masking agent, and a supporting electrolyte, which method is characterized by causing the aluminum material prior to the formation of the anodic oxide film to be subjected to an immersion treatment in a bath containing phosphoric ions or optionally further subjected to an electrolytic treatment and consequently inducing formation of a phosphoric acid-treated anodic oxide film on the surface thereof.

This method is at a disadvantage in suffering the colored oxide film to be deprived of the color in the subsequent steps besides complicating the process thereof and consequently adding to the cost thereof. Particularly, such colored oxide films as utilize the interference of light due to precipitated metals or the geometric shapes of micropores of the anode oxide film are apt to succumb to the disadvantage and suffer heavy change in color at the subsequent steps.

SUMMARY OF THE INVENTION

In the electrolytic coloring process which is performed under conventional conditions, the aluminum material which has undergone the anodic oxidation treatment assumes a bronze color when it is subjected to electrolytic coloring in an electrolytic coloring bath containing nickel sulfate. The aluminum material forms a colored oxide film assuming a bronze color of a grassy tint when the electrolytic coloring bath contains stannous sulfate or a bronze color of a grassy tint to yellowish tint when the electrolytic coloring bath contains both nickel sulfate and stannous sulfate. None of these baths produces a colored oxide film in a relatively dark achromatic gray color.

It is an object of the present invention, therefore, to provide a method for electrolytically coloring an aluminum material which is capable of coloring the anodic oxide film in a gray color with high reproducibility under conventional conditions of electrolytic coloring without requiring any special step and consequently provide at a low cost an aluminum material excellent in various physical properties such as weatherability, resistance to corrosion, and durability and colored in a relatively dark and achromatic or substantially achromatic gray color.

To accomplish the object mentioned above, the present invention provides a method for electrolytically coloring an aluminum material having an anodic oxide film formed on the surface thereof in an electrolytic coloring solution containing an inorganic metal salt, characterized in that a strongly acidic electrolytic coloring solution containing sulfuric acid, stannous sulfate, nickel sulfate, and ammonium sulfate and having a pH of not more than 2.5 is used as the electrolytic coloring solution to color the anodic oxide film gray.

In a preferred embodiment of the present invention, the electrolytic coloring solution mentioned above is an electrolytic coloring solution containing sulfuric acid at a concentration in the range of 3 to 30 g/liter, stannous sulfate at a concentration in the range of 0.1 to 3.0 g/liter, nickel sulfate at a concentration in the range of 10 to 100 g/liter, and ammonium sulfate at a concentration in the range of 20 to 100 g/liter.

By this method, a gray-colored aluminum material possessed of an anodic oxide film colored in an achromatic or substantially achromatic gray color is obtained.

DETAILED DESCRIPTION OF THE INVENTION

The present inventors have continued a study for many years concerning the electrolytic coloring of an aluminum material in an electrolytic coloring bath containing a nickel salt or a stannous salt. They have consequently acquired knowledge that in the electrolytic coloring performed in an acidic bath containing sulfuric acid at a concentration in the approximate range of 5 to 10 g/liter and additionally incorporating therein a sulfate of nickel or titanium, the anodic oxide film of the aluminum material is not colored when the nickel salt alone is added thereto, it is colored when the stannous salt alone is added at a relatively high concentration exceeding about 3.0 g/liter and is barely colored in a light bronze color when the concentration of the stannous salt is in the range of 2.0 to 3.0 g/liter and it is not colored when the tin salt has a low concentration of not more than about 1.5 g/liter. It is suspected that this knowledge has already found widespread recognition. The conventional case which is reported to have obtained a gray-colored oxide film uses a weakly acidic to neutral electrolytic coloring solution having a pH of not less than 5 and incorporating therein a nickel salt, a stannous salt, and tartaric acid.

The stannous salt enjoys stability in an acidic bath and yet suffers immediate precipitation in the weakly acidic to neutral electrolytic coloring solution. When the electrolytic coloring solution contains tartaric acid added thereto to induce chelation for the purpose of enabling the stannous salt to remain stably therein, though it continues to preclude the otherwise possible occurrence of a precipitate, the chelating action consequently generated becomes too strong to permit coloration of the anodic oxide film.

The inventors have made a diligent study on the phenomenon mentioned above and consequently found that the anodic oxide film of the aluminum material can be electrolytically colored in an achromatic or substantially achromatic gray color by using stannous sulfate ($SnSO_4$) and nickel sulfate ($NiSO_4.6H_2O$) as metal salts for addition to the electrolytic coloring solution for use in the electrolytic coloring and, at the same time, further incorporating therein ammonium sulfate [$(NH_4)_2SO_4$] and sulfuric acid ($H_2SO_4$) and consequently form a strongly acidic electrolytic coloring solution having a pH of not more than 2.5.

The fact that the electrolytic coloration of an anodized aluminum material in the gray color is accomplished in spite of the combined use of the conditions for the stannous salt and the conditions for the nickel salt which in the conventional acidic bath have been heretofore held as incapable of coloring the anodic oxide film or barely capable of coloring it in a light bronze color is a truly surprising matter never predicted from the conventional common knowledge.

Even when the strongly acidic bath containing sulfuric acid is used, however, the electrolytic coloring which is carried out by adding stannous sulfate at varying concentrations and nickel sulfate at a concentration in the approximate range of 10 to 100 g/liter to the aqueous solution containing sulfuric acid at a concentration in the approximate range of 1 to 20 g/liter and avoiding addition of ammonium sulfate, for example, produces a colored oxide film assuming a bronze color when the concentration of stannous salt is high (not less than 3.0 g/liter), a light bronze color when the concentration is in the range of 2.0 to 3.0 g/liter, or a gray color tone hardly deserving to be called an achromatic color tone when the concentration is low (not more than 1.5 g/liter). When the electrolytic coloring solution under this condition further contains ammonium sulfate added thereto, the electrolytic coloring carried out therein produces a nearly achromatic gray-colored oxide film. Further, since the electrolytic coloring solution contains sulfuric acid, the colored oxide film enjoys highly satisfactory throwing power and excels in uniformity of coloration.

The electrolytic coloring solution to be used in the present invention, therefore, is basically characterized by containing sulfuric acid, stannous sulfate, nickel sulfate, and ammonium sulfate as essential components and exhibiting strong acidity not exceeding pH 2.5.

Now, the electrolytic coloring process according to the present invention will be described specifically below. First, the aluminum material as the starting material is subjected to such pretreatments as degreasing, etching, neutralizing, washing with water, and optionally desmutting and then subjected to an anodic oxidation treatment in an acidic electrolyte, preferably a sulfuric acid electrolyte. To be specific, the aluminum material is connected to an anode and, in a well known electrolyte of an inorganic acid and/or an organic acid such as, for example, the electrolyte containing an inorganic acid such as, for example, sulfuric acid, chromic acid, or phosphoric acid, or a mixture of such acids, an organic acid such as, for example, oxalic acid or malonic acid or a mixture of such acids, or a mixture of the inorganic acid and the organic acid mentioned above, subjected to a treatment of anodic oxidation using a DC or similar voltage-current waveform or an AC waveform, or an AC-DC superimposed waveform. The voltage to be applied for the treatment of anodic oxidation and the duration of the application are only required to confirm to the standard levels prevailing in the art. Generally, the voltage is preferred to be in the range of 5 to 100 V. If the voltage is less than 5 V, the treatment to obtain a required film thickness calls for such a long duration as to impair productivity. Conversely, if the voltage exceeds 100 V, the treatment at the high voltage proves to be unfavorable because the film thickness is uneven and the waste of energy is intolerably large.

The aluminum material which has formed the anodic oxide film on the surface thereof as described above is now subjected to the electrolytic coloring in accordance with the present invention.

The electrolytic coloring solution must be strongly acidic as mentioned above. The pH value thereof is adjusted to or below 2.5, or preferably to a level in the range of 0.5 to 2.0, and more preferably to a level in the range of 0.5 to 1.5. Thus, the content of sulfuric acid in the solution is preferred to fall in the range of 3 to 30 g/liter. If the content of sulfuric acid is less than 3 g/liter, the pH value of the electrolytic coloring solution will shift to the weakly acidic side and the produced colored oxide film assumes a bronze color.

Then, the concentration of stannous sulfate is preferred to fall in the range of 0.1 to 3.0 g/liter, more preferably 0.2 to 1.5 g/liter and the concentration of nickel sulfate is preferred to be in the range of 10 to 100 g/liter. Particularly, when the concentration of stannous sulfate increases, the produced colored oxide film is liable to assume a chromatic color tone and a bronze color. Thus, it should be not more than 3.0 g/liter.

Ammonium sulfate is added particularly when the concentration of sulfuric acid is low for the purpose of improving the electric conductivity of the solution. In the electrolytic coloring solution of the composition contemplated by the present invention, it has the function of shifting the color tone of the produced colored oxide film to the gray tone. The addition of ammonium sulfate in an unduly large amount is unfavorable because the ammonium sulfate of an unduly high concentration tends to lighten the color tone of the produced colored oxide film and ammonium sulfate reacts with Ni ions and tends to form nickel ammonium sulfate which is not easily soluble in an aqueous solution.

The concentration of ammonium sulfate, therefore, is preferred to be in the range of 20 to 100 g/liter, particularly in the range of 30 to 75 g/liter.

The other conditions for the electrolytic coloring such as, for example, the current waveform, the current density, the duration of electrification, and the temperature of the bath, may be suitably selected from the ranges which are used for the conventional method of electrolytic coloring of the aluminum material. The working voltage, for example, suffices in the approximate range of 5 to 30 V and the duration of electrification is appropriate in the approximate range of 0.5 to 10 minutes. As respects the current waveform, though the AC or AC-DC superimposed current may be adopted, it is convenient to use the ordinary AC power source in its unmodified form. As the counter electrode, a carbon, tin, or nickel plate may be utilized as in the conventional electrolytic coloring process.

Incidentally, the gray color tone of the produced colored oxide film may be darkened by using a current waveform having the + component of the sine wave increased during the course of electrification or by suitably changing the method of electrification. $Sn^{2+}$ at times is oxidized into $Sn^{4+}$ and precipitated to induce deterioration of the solution. For the purpose of preventing this phenomenon, the electrolytic coloring solution is preferred to add a weakly reducing substance.

The method of the present invention, as described above, enables the anodic oxide film to be uniformly colored in a relatively dark achromatic or substantially achromatic gray color under the standard conditions of electrolytic coloring with high reproducibility because this method, in the electrolytic coloring of an aluminum material having an anodic oxide film formed on the surface thereof in an electrolytic coloring solution containing inorganic metal salts, uses a strongly acidic electrolytic coloring solution containing sulfuric acid, stannous sulfate, nickel sulfate, and ammonium sulfate and having a pH of not more than 2.5. Moreover, the electrolytic coloring solution is stable and can be used for a long time.

The method, therefore, can provide aluminum materials having an achromatic or substantially achromatic gray color which proves to be highly suitable commercially and in terms of design as well and excelling in various properties such as weatherability, resistance to corrosion, and durability by a simple procedure at a low cost.

Now, the present invention will be described more specifically below with reference to working examples and comparative examples.

EXAMPLES 1–3

An aluminum material, A6063, which had undergone the degreasing, etching, and neutralizing treatments in the usual way was immersed in a bath containing sulfuric acid at a concentration of 180 g/liter and kept at 20° C. and subjected to an anodic oxidation treatment at a current density of 1.1 $A/dm^2$ for 35 minutes.

Next, the aluminum material which had undergone the treatment of anodic oxidation described above was immersed in an electrolytic coloring solution of a varying composition shown in Table 1 and kept at 28° C. and subjected to an AC electrolytic coloring using a counter electrode of carbon at 12 V for four minutes.

The consequently produced colored oxide film was tested for the condition of coloration by the use of a differential calorimeter (produced by Minolta Camera Co., Ltd. and marketed under product code of "CR-300"). In the table, "L" represents the psychometric lightness and "a" and "b" represent the psychometric chroma coordinates. The symbol "L" has a significance such that the darkness of color increases in proportion as the value thereof decreases and the "a" and "b" have significances such that the color approximates closely to the achromatic color in proportion as the values thereof decrease. The ideal achromatic color exists when a=b=0 occurs. The value of "b" is preferred to be not more than 2.5.

The results are additionally shown in Table 1.

TABLE 1

| Example No. | 1 | 2 | 3 |
|---|---|---|---|
| Composition of bath (g/l): | | | |
| $H_2SO_4$ | 6 | 10 | 6 |
| $SnSO_4$ | 0.4 | 0.6 | 0.4 |
| $NiSO_4.6H_2O$ | 40 | 40 | 40 |
| $(NH_4)_2SO_4$ | 40 | 50 | 20 |
| L value | 66.2 | 67.1 | 65.1 |
| a value | −0.32 | −0.08 | +0.38 |
| b value | +1.85 | +1.37 | +4.30 |
| Remark | | | Slighly yellowish gray |

It is clearly noted from the results shown in Table 1 that the anodic oxide films of the samples of aluminum material of Examples 1 and 2 were uniformly colored in an achromatic or substantially achromatic gray color, whereas the film of the sample of Example 3 was colored in a slightly yellowish gray color. From the results, it is clear that the lower limit of the concentration of ammonium sulfate for the electrolytic coloring of the anodic oxide film to produce an achromatic or substantially achromatic gray color was 20 g/liter.

COMPARATIVE EXAMPLES 1–8

The aluminum material was subjected to an anodic oxidation treatment and an electrolytic coloring treatment by following the procedure of Examples 1–3 while using the electrolytic coloring baths of compositions shown in Table 2.

The results are additionally shown in Table 2.

TABLE 2

| Comparative Example No. | 1 | 2 | 3 | 4 | 5 | 6 | 7 | 8 |
|---|---|---|---|---|---|---|---|---|
| Composition of bath (g/l): | | | | | | | | |
| $H_2SO_4$ | 6 | 6 | 6 | 6 | 6 | 6 | 10 | 0.8 |
| $SnSO_4$ | 0.4 | 0 | 2.0 | 3.5 | 0.6 | 5.0 | 6.0 | 0.6 |
| $NiSO_4.6H_2O$ | 0 | 40 | 0 | 0 | 60 | 40 | 40 | 50 |
| $(NH_4)_2SO_4$ | 20 | 20 | 20 | 20 | 0 | 20 | 50 | 50 |

TABLE 2-continued

| Comparative Example No. | 1 | 2 | 3 | 4 | 5 | 6 | 7 | 8 |
|---|---|---|---|---|---|---|---|---|
| L value | 81.7 | | 71.3 | 55.49 | 62.0 | 43.22 | 41.6 | 56.1 |
| a value | −0.08 | | −0.36 | −0.04 | +0.85 | +1.61 | +1.76 | +1.32 |
| b value | +0.17 | | +6.03 | +11.40 | +5.89 | +8.80 | +9.60 | +6.89 |
| Remarks | not colored | | light bronze | bronze | light yellowish bronze | | bronze | |

The electrolytic coloring solutions of Comparative Examples 1 and 2 which did not contain either nickel sulfate or stannous sulfate could not color the anodic oxide films of aluminum material as shown in Table 2. The solution of Comparative Example 3 which contained no nickel sulfate and contained stannous sulfate at a low concentration could color but imparted a light bronze color to the film and the solution of Comparative Example 4 which contained stannous sulfate at a relatively high concentration imparted a bronze color to the film. The solution of Comparative Example 5 which contained no ammonium sulfate produced a light yellowish bronze color on the film. The solutions of Comparative Examples 6 and 7 containing stannous sulfate at high concentrations and the solution of Comparative Example 8 which contained sulfuric acid at a low concentration and consequently had a pH of not less than 2.5 invariably produced a bronze color on the films.

EXAMPLE 4

The aluminum material was subjected to an anodic oxidation treatment and an electrolytic coloring treatment by following the procedure of Examples 1–3 while using an electrolytic coloring bath containing sulfuric acid at a concentration of 6 g/liter, nickel sulfate at a concentration of 60 g/liter, ammonium sulfate at a concentration of 50 g/liter, and stannous sulfate at a varying concentration shown in Table 3.

The results are collectively shown in Table 3.

TABLE 3

| Run No. | 1 | 2 | 3 | 4 |
|---|---|---|---|---|
| $SnSO_4$ (g/l) | 0.4 | 0.6 | 0.8 | 3.5 |
| L value | 66.8 | 66.4 | 66.5 | 62.0 |
| a value | +0.26 | −0.03 | −0.02 | +0.31 |
| b value | +1.47 | +1.67 | +2.14 | +6.36 |
| Remark | | | | yellowish |

It is clearly noted from Table 3 that the color of the anodic oxide film gradually gained in yellowishness and approximated closely to bronze as the concentration of stannous sulfate increased.

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What we claim is:

1. A method for electrolytically coloring an aluminum or aluminum alloy material having an anodic oxide film formed on a surface thereof in an electrolytic coloring solution containing inorganic metal salts, comprising using as said electrolytic coloring solution a strongly acidic electrolytic coloring solution containing in combination sulfuric acid, stannous sulfate, nickel sulfate, and ammonium sulfate and having a pH of not more than 2.5 to color said anodic oxide film gray.

2. The method according to claim 1, wherein said electrolytic coloring solution contains sulfuric acid at a concentration in the range of 3 to 30 g/liter, stannous sulfate at a concentration in the range of 0.1 to 3.0 g/liter, nickel sulfate at a concentration in the range of 10 to 100 g/liter, and ammonium sulfate at a concentration in the range of 20 to 100 g/liter.

3. The method according to claim 2, wherein the concentration of stannous sulfate is in the range of 0.2 to 1.5 g/liter and the concentration of ammonium sulfate in the range of 30 to 75 g/liter.

4. The method according to claim 1, wherein said electrolytic coloring solution has a pH in the range of 0.5 to 2.0.

5. A gray-colored aluminum material possessed of an anodic oxide film caused to assume a gray color by the method set forth in claim 1.

* * * * *

UNITED STATES PATENT AND TRADEMARK OFFICE

CERTIFICATE OF CORRECTION

PATENT NO. : 5,849,169

DATED : December 15, 1998

INVENTOR(S) : Kazuo Aikawa, et al

It is certified that error appears in the above-identified patent and that said Letters Patent is hereby corrected as shown below:

On the title page: Item [54] Title: please delete "ELECTRICALLY" and insert --ELECTROLYTICALLY--.

Column 1, line 3, please delete "ELECTRICALLY" and insert --ELECTROLYTICALLY--.

Signed and Sealed this

Seventeenth Day of August, 1999

*Attest:*

Q. TODD DICKINSON

*Attesting Officer*

*Acting Commissioner of Patents and Trademarks*